US006284318B1

(12) United States Patent
Jackson

(10) Patent No.: US 6,284,318 B1
(45) Date of Patent: Sep. 4, 2001

(54) PAINTING METHOD WITH LONG-NAPPED WOOL COVERED ROLLERS

(75) Inventor: Susan A. Jackson, Plymouth, MN (US)

(73) Assignee: Wagner Spray Tech Corporation, Minneapolis, MN (US)

( * ) Notice: Subject to any disclaimer, the term of this patent is extended or adjusted under 35 U.S.C. 154(b) by 0 days.

(21) Appl. No.: 09/567,550

(22) Filed: May 5, 2000

Related U.S. Application Data

(62) Division of application No. 09/220,567, filed on Dec. 23, 1998.

(51) Int. Cl.[7] ..... B05D 1/28

(52) U.S. Cl. ..... 427/260; 427/262; 427/280; 427/428; 15/236.03; 15/230.11; 492/13; 492/19

(58) Field of Search ..... 427/428, 260, 427/262, 280; 15/142, 236.03, 230.11, 257.06; 492/19, 13

(56) References Cited

U.S. PATENT DOCUMENTS

| | | | | |
|---|---|---|---|---|
| 2,680,873 | | 6/1954 | Ernst | 15/235 |
| 2,735,128 | | 2/1956 | Adams | 15/230 |
| 2,838,781 | | 6/1958 | Molle | 15/121.1 |
| 2,955,309 | | 10/1960 | Brown, Jr. | 15/119 |
| 3,554,659 | | 1/1971 | Stokes | 401/197 |
| 3,562,837 | | 2/1971 | Baginski et al. | 15/230.11 |
| 4,000,537 | | 1/1977 | Woo | 15/230.11 |
| 4,100,007 | * | 7/1978 | Van Zeeland | 15/230.11 |
| 4,401,476 | | 8/1983 | Klaiber | 134/33 |
| 5,713,095 | * | 2/1998 | Wakat | 15/230.11 |
| 5,866,206 | | 2/1999 | Jennings-Tolchiner | 427/261 |

FOREIGN PATENT DOCUMENTS 2172820A 10/1986 (GB) .

OTHER PUBLICATIONS

Product Brochure, "Royal Paint Roller Manufacturing Corp" (No Date).

* cited by examiner

*Primary Examiner*—Katherine A. Bareford
(74) *Attorney, Agent, or Firm*—Faegre & Benson, LLP

(57) ABSTRACT

A paint applicator and method for applying a decorative finish to a surface including a dual roller handle and a pair of roller covers formed from long-napped wool, each roller cover mounted for independent rotation on the dual roller handle. When at least two paints having at least one different visually perceptible characteristic are respectively simultaneously applied to the surface by the pair of long-napped wool roller covers using the handle in an overlapping and arcing motion the decorative finish results. The resulting decorative finish is substantially similar to a surface finish created by a wool pad applicator, but is applied in much less time and with much less effort than that created by the wool pad applicator.

12 Claims, 5 Drawing Sheets

PAINTING METHOD WITH LONG-NAPPED WOOL COVERED ROLLERS

This is a divisional application of application Ser. No. 09/220,567, filed on Dec. 23, 1998 and entitled PAINT APPLICATOR WITH LONG-NAPPED WOOL COVERED ROLLERS.

FIELD OF THE INVENTION

This invention relates to paint applicators and methods using a pair of long-napped wool roller covers for applying decorative finishes to surfaces.

BACKGROUND OF THE INVENTION

The use of lambskin, sheepskin, or wool rollers for applying paint to a surface has been known for many years. Some of the first painting rollers were formed from sheepskin, napped wool or wool felt due to the availability and suitability of the material, and the lack of alternatives. The advent of synthetic fibers resulted in the availability of suitable synthetic paint rollers that were cheaper and more readily disposable, however some painters still preferred wool to other fibers.

The purpose of the roller material is to absorb paint quickly and provide relatively even paint distribution throughout the roller material and, thus, smooth paint application onto a surface. The ultimate purpose of the paint roller is to provide fast and even coverage of a surface with the desired paint. A painter's choice of roller material would be based, in part, on how well the material met this purpose. Ease of cleanup, including washing effort, drying time, or disposability, also played a part in the painter's decision.

Traditional wool and synthetic paint rollers are available in a variety of nap lengths chosen depending on the surface to be painted. Smooth surfaces are usually painted with short napped rollers, ¼ inch in length, that provide a smooth and even paint application. Surfaces with some texture or roughness are usually painted with medium napped rollers, ⅜–½ inch in length. The longer nap length facilitates paint application into the crevices as well as the raised areas of the rougher surface. Rough surfaces require long napped rollers, ¾ inch in length, to accommodate the variations in surface texture. For extremely rough surfaces, very long napped rollers in length of 1 to 1¼ inch can be used. For most normal or average wall surfaces, shorter napped rollers, i.e., ¼–½ inch, are usually preferred due to their even absorption and smooth application of paint without unwanted surface effects, such as streaking, dripping, texturizing, or pattern formation.

On the other hand, in situations in which a decorative, texturized or patterned finish is desired, a number of other types of paint rollers have been developed. These include: embossed rollers; open webbed coarse filament, fiber or stranded material rollers; pile fabric, carpet fabric, and mohair fabric rollers; and plain and patterned foam rollers. In addition, attempts have been made to simulate the effect of, while simplifying the application of other traditional surface finishes, such as sponging, rag rolling, stippling, and marbleizing, by attaching rags, flaps or other projections onto a roller surface.

In addition to paint rollers, paint pads have been developed to provide an alternative tool for producing decorative finishes. Pad materials, such as foam, wool, sponge, fibers and other textured materials, are capable of producing finishes that are very pleasing and often substantially similar to the traditional surface finish techniques described above.

For painted finishes requiring multiple colors or characteristics, paints are applied sequentially or, in some cases, simultaneously with the use of two or more pads at the same time. Producing a decorative finish by pad application, although effective, tends to be slower and more physically taxing than paint roller application methods.

With the increase in interest in do-it-yourself home application of surface finishes, instead of the traditional use of professional decorators or painters to achieve the desired effect, the need for ever simpler, faster and more cost effective decorating tools has also increased. Although numerous tools are currently available, as discussed above, each has its drawbacks and shortcomings.

SUMMARY OF THE INVENTION

The paint applicator of the present invention has a dual roller handle and a pair of long-napped wool roller covers mounted for independent rotation on the dual roller handle. When this paint applicator is used with at least two paints having at least one different visually perceptible characteristic it provides a tool for achieving very pleasing, yet simple, fast and cost effective decorative surface finishes. These decorative surface finishes are very similar to those achievable with a pad applicator or with other techniques, but are producible in a fraction of the time and effort.

DETAILED DESCRIPTION OF THE INVENTION

Figure 1:
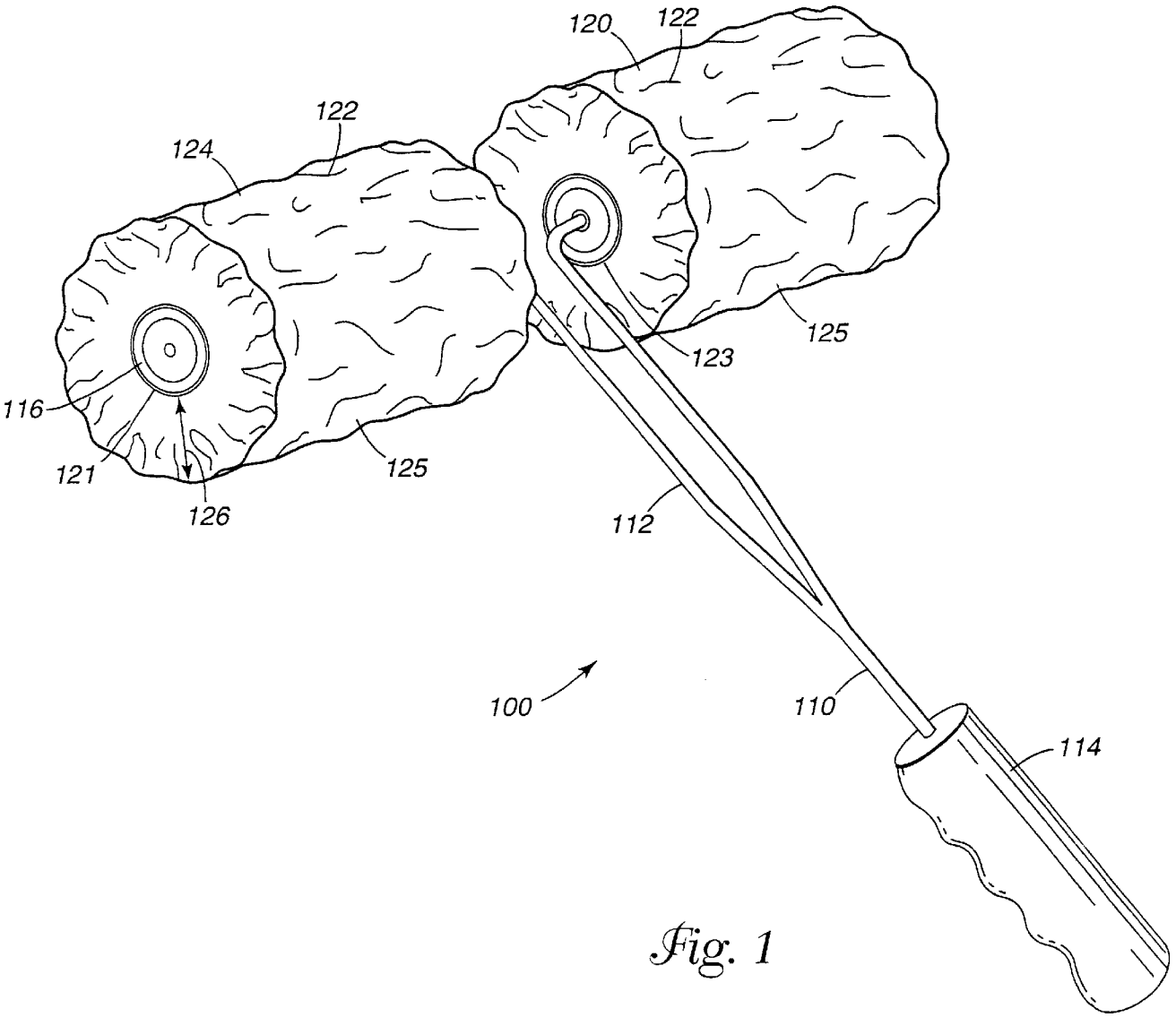
FIG. 1 is a perspective view of a paint applicator of the present invention having two rollers with long-napped wool roller covers.
Figure 2:
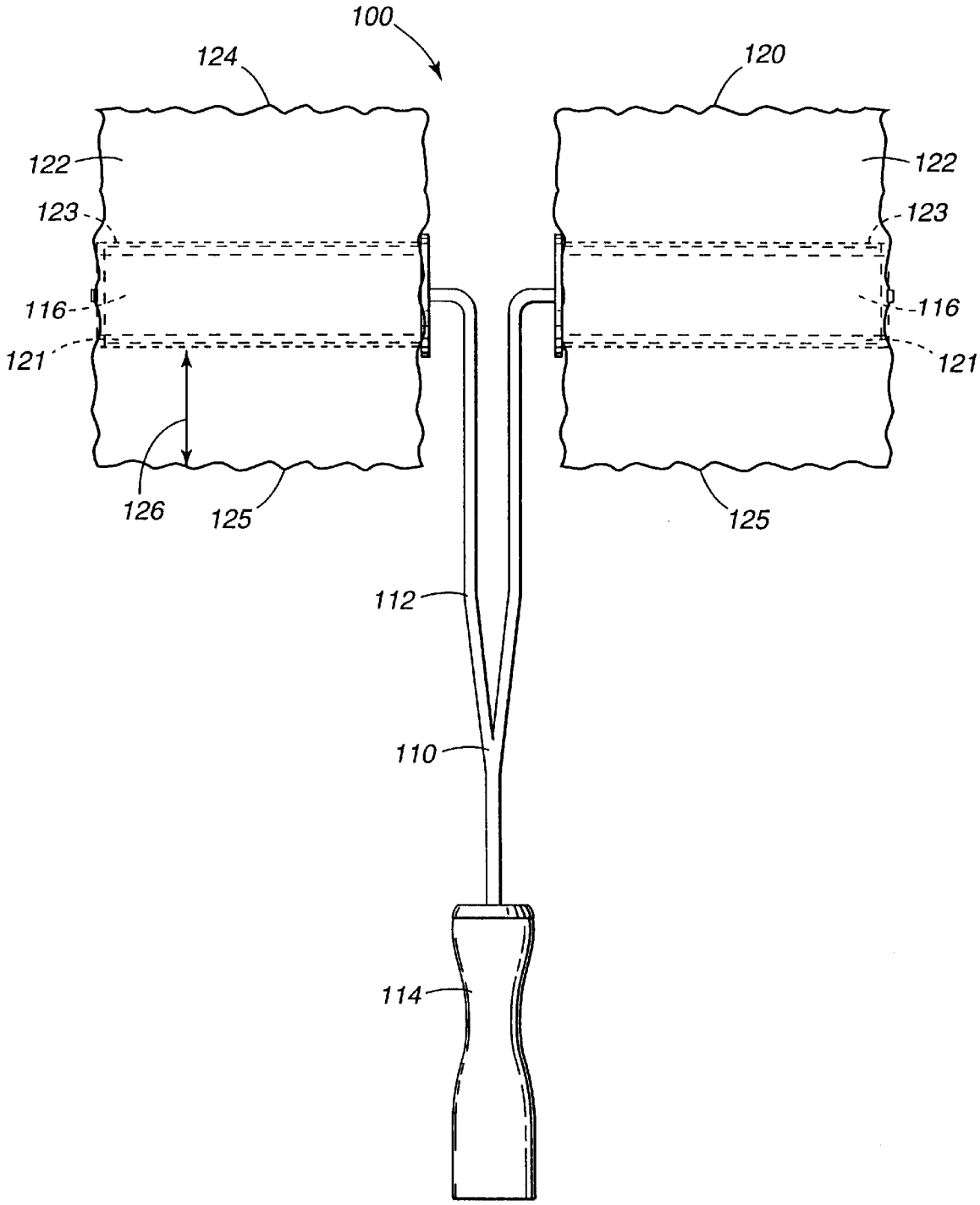
FIG. 2 is a top view of the paint applicator of FIG. 1.

With reference to the attached Figures, it is to be understood that like components are labeled with like numerals throughout the several Figures. FIGS. 1 and 2 illustrate a paint applicator 100 useful in the present invention for creating a decorative finish on a surface to be coated or painted. As used herein, a decorative surface finish is any of a number of coatings applied to a surface to decorate the surface with a desired visual effect. A decorative surface finish may simulate traditional surface finishes, such as fresco, sponging, rag rolling, marbleizing, or other texturizing looks, or it may provide a pattern, design or image, or it may just provide color or other visually perceptible characteristic variations. Additionally, as used herein, the term paint implies any type of fluid coating applicable to a surface to produce a decorative surface finish. The paint applicator 100 includes a roller handle 110 and two roller mechanisms 116 each mounted for independent rotation. The roller handle 110 includes a grip 114 and a split shaft 112 to which the roller mechanisms 116 are mounted.

Two roller covers 120, 124 are mounted on the roller mechanisms 116 to complete the paint applicator 100. These two roller covers 120, 124 are labeled as a right-hand roller cover 120 and a left-hand roller cover 124 with reference to the illustrations in FIGS. 1–3. Each roller cover 120, 124 comprises a core 121 and a long-napped wool layer 122 having a nap length 126, and each cover is preferably removable and interchangeable to allow for versatility in the use of the paint applicator 100 and ease of cleanup. Although each roller cover 120, 124 may be different, it is preferable to use two roller covers 120, 124 of the same type and nap length 126 to achieve the desired decorative finish.

The core 121 may be formed from a number of materials, including, but not limited to paper, cardboard, phenolic, or plastic, such as PVC. The core 121 may be disposable or reusable, but preferably is capable of being used and washed enough times to allow for at least the complete application of a decorative finish to an entire reasonably sized room. The core 121 can be sized to meet application requirements, both in length and diameter, however ease of use can provide practical limitations on size. For example, if the core 121 is too large, the weight of a dual roller applicator when loaded with paint can pose fatigue and control problems for the user. If, on the other hand, the core 121 is too small, the amount of surface area coverage is limited, thus requiring more time and effort to produce a decorative finish on an entire surface. Preferably, the core 121 will be sized between 4 and 7 inches in length, and 1.5 to 1.75 inches in diameter. The thickness of the core 121 can vary depending on the strength of the material chosen. Preferably, however, the thickness will follow industry standards in the range of about 1/16 to about 1/8 inches.

Each long-napped wool layer 122 is preferably formed from natural sheepskin 123 wrapped about the core 121. By sheepskin it is meant any natural skin of a sheep or lamb upon which the natural wool remains. Natural sheepskin is durable, washable, and applies paint in a desired manner. Alternatively, natural long-napped wool that has been removed from the sheepskin and attached to another type of backing may also be used to form the wool layer 122. The wool layer 122 may also be formed from a long-napped wool blend material, however such material has been tested and proven to be less desirable than all natural wool. The long-napped wool layer 122 has a nap length 126 that is very long for a paint roller, the type of nap length offered commercially for painting rough and extra rough surfaces. Nap lengths 126 should be greater than about 3/4 inch, and preferably in excess of one inch to provide the desired decorative finish. The outer surface 125 provided by the natural wool of the long-napped wool layer 122 is relatively smooth and fluffy, as shown, when it is dry.

Although a split shaft type paint applicator 100 is shown, the present invention is not limited to this specific paint applicator design. Any other type of roller paint applicator, such as, for example, a T-shaft design, now known or later designed, providing independent rotational mounting for at least two roller covers is also contemplated for use with the present invention. It is to be understood, however, that it is preferable to be able to simultaneously load each roller cover 120, 124 with paint to maintain efficiency.

Figure 3:
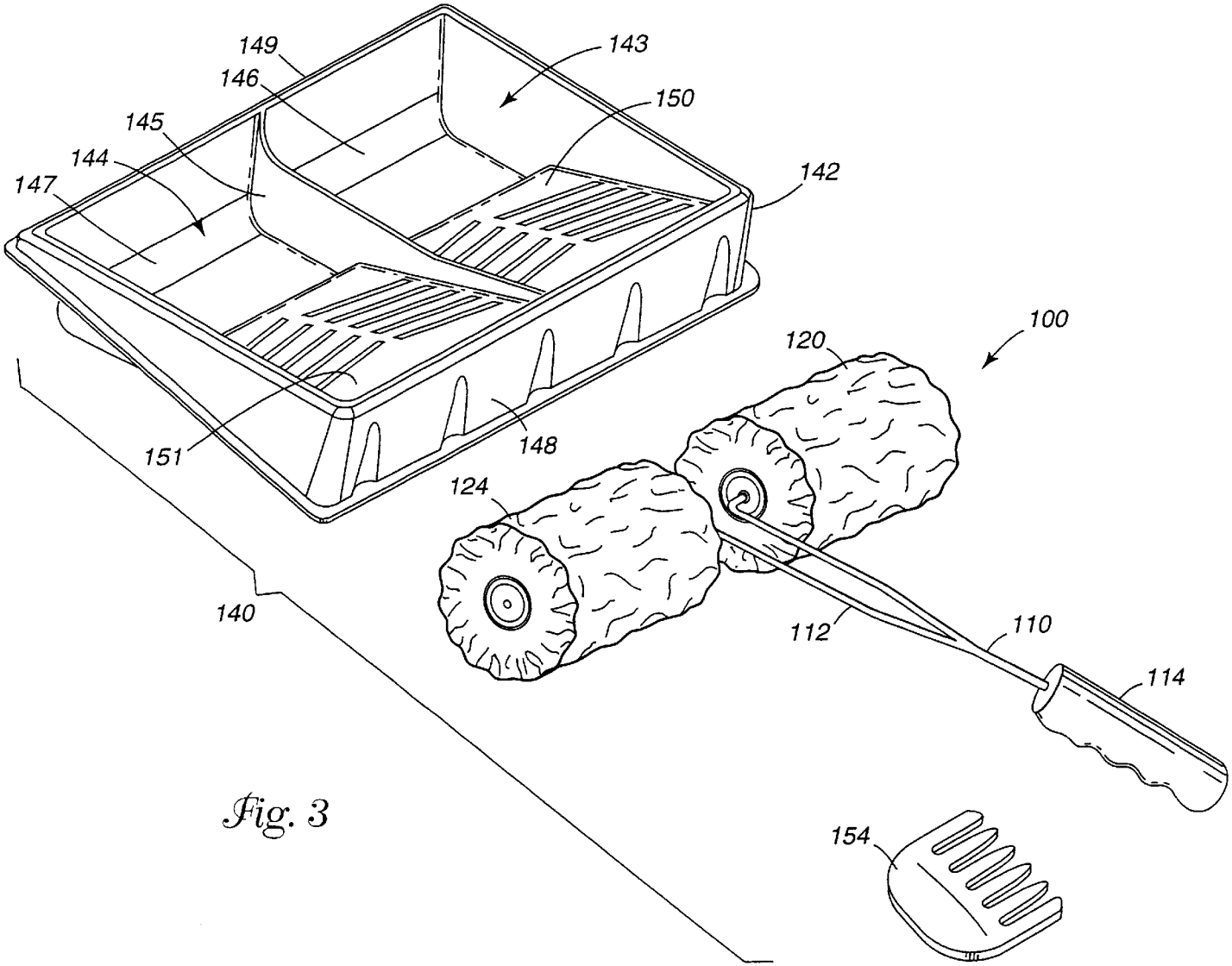
FIG. 3 is a perspective view of a paint applicator kit including the paint applicator of FIG. 1 and a bifurcated paint tray, together with a nap lifter.

The paint applicator 100 may be used in conjunction with a paint tray, such as the bifurcated paint tray 142 shown in FIG. 3. The type of paint applicator handle 110 used will determine, in part, the type of paint tray required for a given paint applicator 100 and decorative surface finish application. For a split shaft handle 110, a bifurcated paint tray 142 provides a means for applying different paints to the two long-napped wool roller covers 120, 124 simultaneously. The bifurcated paint tray 142 has two separate compartments 143, 144 that are separated by a divider 145 that runs lengthwise from a first outer wall 148 to an opposite second outer wall 149. Adjacent the first outer wall 148 within each compartment 143, 144 are sloped paint distribution areas 150, 151. These paint distribution areas 150, 151 slope downward, each toward respective reservoirs 146, 147 into which paint (not shown) is poured for loading onto the paint applicator 100. The roller covers 120, 124 of the paint applicator 100 are loaded with paint by simultaneous dipping into the paint within the reservoirs 146, 147. The split shaft 112 of the paint applicator handle 110 straddles the divider 145 allowing the long-napped wool roller covers 120, 124 to be simultaneously loaded with paint. The roller covers 120, 124 may then be rolled back and forth on the paint distribution areas 150, 151 to distribute the paint more evenly about the long-napped wool of the roller covers 120, 124.

The combination of the paint applicator 100, the bifurcated paint tray 142 and the paint (not shown) form a paint applicator kit 140 providing the necessary components to produce a decorative surface finish under the present invention. An optional nap lifter 154, as shown in FIG. 3, may also be provided as part of the kit 140 to fluff the wool nap during use when the nap becomes relatively saturated with paint. The nap lifter 154 is a comb-like tool, similar to a commercially available hair lifter, that lifts wool fibers that become matted by the paint and thus lie pressed against the core.

The creation of a decorative finish on a desired surface under the present invention requires the application of paint to the desired surface by the paint applicator 100 that includes the pair of roller covers 120, 124 each having the long-napped wool layer 122. The roller covers 120, 124 of the paint applicator 100 facilitate the simultaneous application of at least two paints to the desired surface. In order to achieve the decorative finish, the two paints must have at least one different visually perceptible characteristic.

These characteristics can include hue, intensity, saturation, luminescence, shade, tint, glossiness, pearlescence, or other visually perceptible phenomena. To add more definition or variation to the decorative finish, additional paints may be added to the initial two different paints. One technique is to drizzle a small amount of a third different paint into one of the two initial paints within the paint tray, and then load these paints onto the roller covers and apply to the surface in the described manner. Another technique is to apply another paint or glaze over the entire surface after a first decorative finish has been completed. The number of techniques available to enhance the decorative surface finish under the present invention are limited only by the imagination of the user, and all are within the scope of the invention.

The first step in producing the decorative finish on the desired surface is the application of the two different paints to the two roller covers 120, 124, respectively, on the paint applicator 100. This step may be referred to as loading the roller covers with paint. A dual compartment paint tray, such as the bifurcated paint tray 142 described above, two separate paint pans, or other appropriate means known in the art, may be used to accomplish this step of the process. The long-napped wool layer 122 of each of the roller covers 120, 124 absorbs some of one of the paints, thus allowing for subsequent application of the paints to the desired surface. If the paints to be applied are water based, each long-napped wool layer 122 is preferably wetted lightly with water prior to initially loading the paints onto the roller covers 120, 124, in order to facilitate absorption and adherence of the paint to the wool fibers.

The second step of the process is the application of the two paints on the two roller covers 120, 124 to the desired surface. This application occurs by contacting the long-napped wool layer 122 of each of the two roller covers 120, 124 of the paint applicator 100 with the desired surface, such as surfaces to be coated 162 or 170, shown in FIGS. 6 and 5, respectively. The paint on the outer surface 125 of each wool layer 122 transfers to the surface 162 or 170 on contact.

Figure 4:
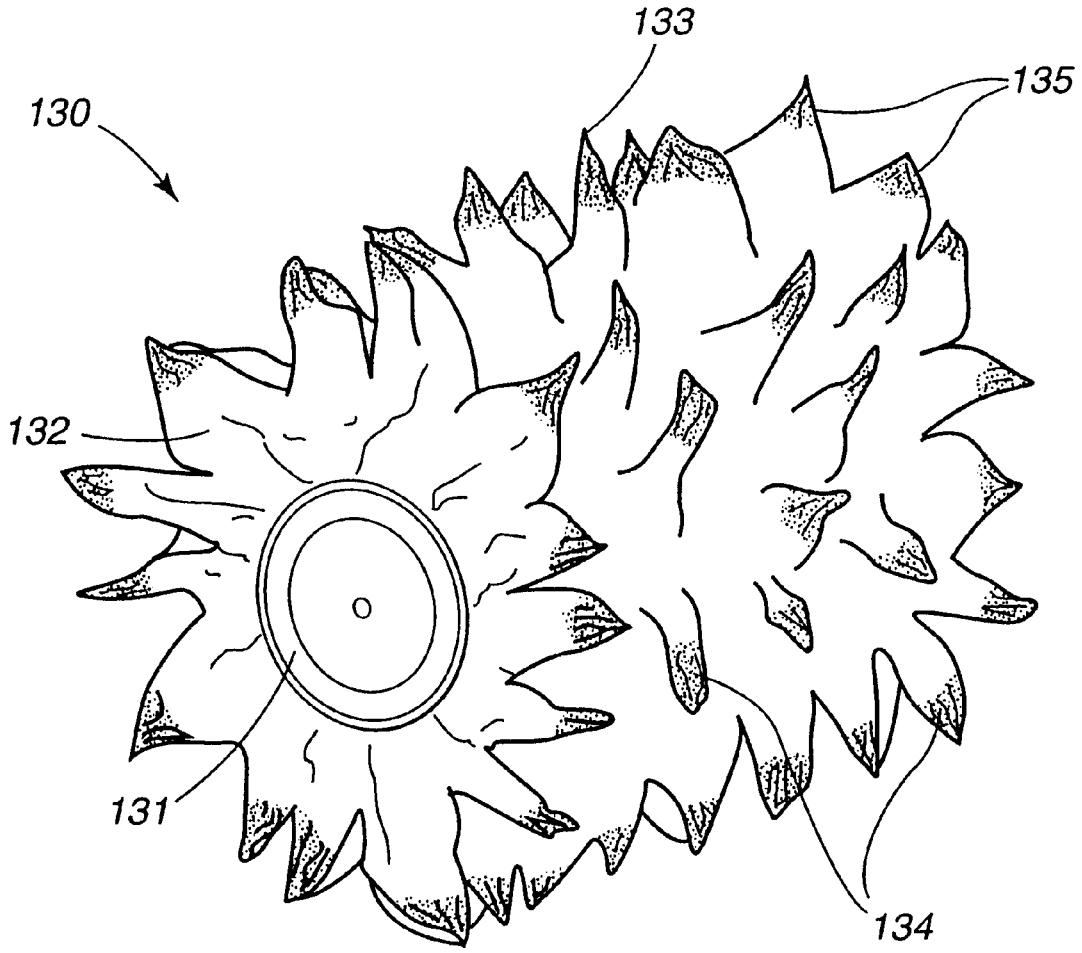
FIG. 4 is a perspective view of a long-napped wool roller cover for use in the present invention loaded with paint.
Figure 5:
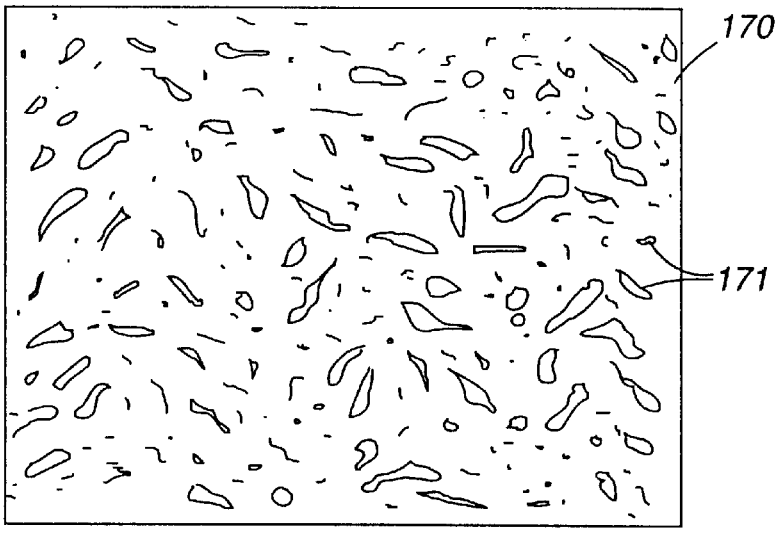
FIG. 5 is plan view of a surface such as a wall over which a long-napped wool roller cover of the present invention has passed without overlapping.

A roller cover 130 that has been loaded with paint 134 is shown in FIG. 4. The roller cover 130 has a core 131 and a long-napped wool layer 132, similar to the roller covers 120, 124 shown in FIGS. 1–3. However, instead of having a long-napped wool layer 132 that is relatively smooth and fluffy (as described above), the wool fibers of the long-napped wool layer 132 have agglomerated with the paint 134 resulting in an outer surface 133 formed from wool fiber tips 135. With the long-napped wool fibers, the tips 135 have been observed and are believed to act like individual paint brushes when the roller cover 130 is rolled across a surface, depositing varying amounts of paint 134 in varying shapes and orientations. A representation of the type of paint deposits 171 that may be made by a long-napped wool roller cover 130 when it passes across a surface 170 without overlapping is shown in FIG. 5. As the roller cover 130 continues to roll across the surface 170, the long-napped wool fibers are believed to subsequently regroup forming different tips 135, thereby providing a more random distribution of paint 134 on the surface 170. The application of the paint 134 to the surface using roller cover 130 occurs on contact, requiring very little pressure. Increased pressure during application of the paint 134 causes larger deposits of paint 171 to occur.

Figure 6:
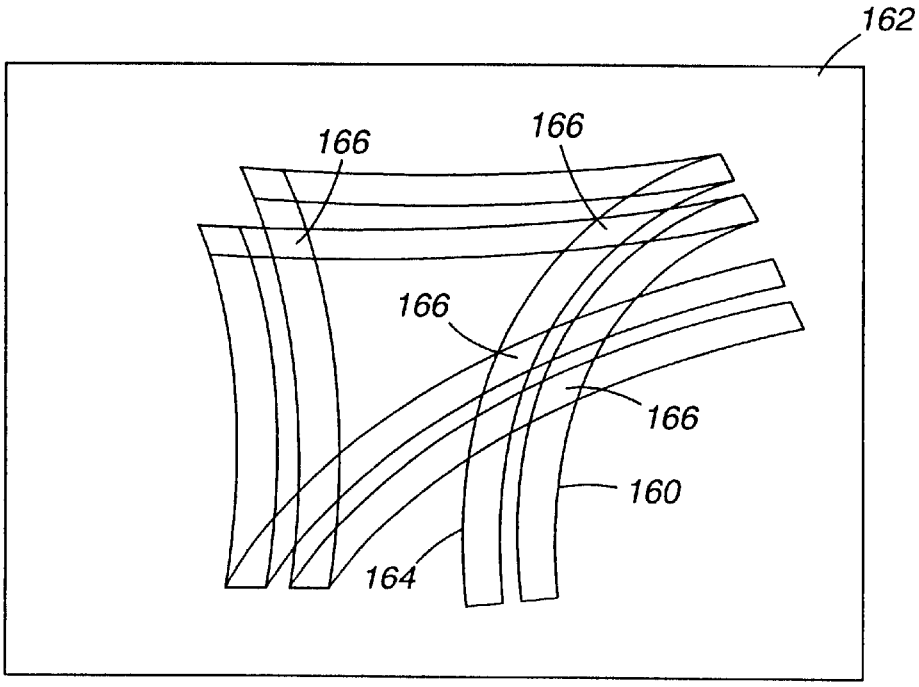
FIG. 6 is a plan view of a surface such as a wall demonstrating one application technique using a paint applicator of the present invention.

After contact with the surface to be decorated 162, the paint applicator 100 is moved about the surface 162 in a substantially continuous overlapping and arcing motion, keeping the roller covers 120, 124 in contact with the surface 162. As shown in FIG. 6, each roller cover 120, 124 produces a paint band 160, 164, respectively. The overlapping and arcing motion causes an overlapping of the two paint bands 160, 164 resulting in blended paint areas 166. The arcing motion should occur while the roller covers 120, 124 are rolling on the surface 162 in order to minimize the possibility of producing smeared or feathered paint effects. The overlapping and arcing motion is repeated across the whole surface to be coated 162, reloading the roller covers 120, 124 with paint as needed, until the surface 162 is coated with paint to the desired degree and the desired decorative finish is created. The repeated overlapping of the two paint bands 160, 164 results in a blended, yet non-uniform variegated appearance of paint upon the coated surface 162.

As the roller covers 120, 124 are loaded with paint and passed over the surface to be coated 162 or 170, the paint discharges at the outer surface 125 of each long-napped wool layer 122. When the roller covers 120, 124 are loaded with paint they resemble roller cover 130 (shown in FIG. 4), and the paint 134 is discharged from the outer surface 133 at the long-napped wool fiber tips 135. This discharged paint leaves paint deposits 171 like those shown in FIG. 5. Further passes of the roller covers 120, 124 overlapping the paint deposits 171 add to the paint deposits 171 and blend the two different paints. The resulting effect resembles a fresco finish having an appearance of texture formed by the different paint deposits 171 that are not totally blended being overlaid upon, and interspersed with the blended paints. More texture may be achieved by not over-rolling the paint deposits 171 with further paint, however, a minimum amount of over-rolling is needed to achieve surface coverage by the paint. The selective application of pressure to a roller cover 130 against the surface 162 or 170 causes more pronounced blending or paint deposits 171 of that paint 134. Pressure may be varied as the handle is moved in the overlapping and arcing motion in order to produce more pronounced blending or paint deposits 171 from either roller cover 120, 124, as desired.

As illustrated in FIG. 5, and unlike the illustration in FIG. 6, when the long-napped wool rollers 120, 124 pass over the surface 162 or 170 no edge marks are produced. As the nap length 126 gets shorter, edge marks become more pronounced such that at the short lengths, less than ½ inch, a pass of the paint applicator 100 would look similar to FIG. 6. The more pronounced the edge marks are, the more difficult it becomes to blend them away without losing the textured effect of the decorative surface finish. The long-napped wool rollers 120, 124 have such a large thickness of wool between the surface and the core during application that, even with a great deal of pressure against the surface, the edges and the core are cushioned from contacting the surface and causing edge marks.

The differences in visually perceptible characteristics between the two paints cause the paint deposits 171 left by the long-napped wool fiber tips 135 to be visible when the paint deposits 171 are not obscured by additional application of paint. The greater the difference in characteristic between the two paints, the more pronounced the paint deposits 171 become against the blended paint areas.

The process of the present invention whereby the paint applicator 100 having a pair of roller covers 120, 124 formed from long-napped wool 122 creates a decorative finish on a surface may be achieved in very little time. Paint application onto a surface is rapid using the pair of roller covers 120, 124 because the amount of surface area covered by each pass of the roller covers 120, 124 across the surface is greater with long-napped rollers than with short-napped rollers. The perimeter of the roller cover increases relative to the radius of the roller cover. Thus, the perimeter of a roller cover having a 1¼ inch nap and a 1½ inch core diameter is about twice as large as a roller cover having a ¼ inch nap on the same core. Although some reduction in radius will occur for the long-napped roller covers 120, 124 due to compression of each long-napped wool layer 122, it is clear that the long-napped rollers will still cover more surface area with the same amount of rolling. Use of axially longer roller covers will also increase the coverage, however, as discussed above, a trade-off occurs between coverage and control when the roller covers become too large.

Another factor contributing to the speed of coverage of a surface by a decorative finish under the present invention is the amount of blending and overlapping required to obtain a desired finished effect. The paint applicator 100 having long-napped wool roller covers 120, 124 achieves a desirable effect quickly and with little effort, in part because of its application technique of rolling along the surface. In fact, it has been found that the paint applicator 100 of the present invention can produce a decorative finish substantially similar to that of a commercially available wool pad applicator, but in considerably less time and with less effort. As used herein, substantially similar decorative finishes include finishes that are indistinguishable from other finishes created by the same or by different application techniques. The wool pad applicator requires a great deal more time and effort to achieve a comparable effect because of its limited surface area coverage and its application technique of being repeatedly pressed against the surface in different locations. In addition, the pad applicator must be applied with a larger amount of pressure at the surface than is required with the paint applicator 100 of the present invention in order to obtain sufficient paint coverage of the surface. Light pressure will produce paint deposits on the surface, but subsequent applications of paint by the pad applicator with light pressure do not seem to fill in the surface and provide coverage by the paints. Requiring less pressure at the surface makes the use of the paint applicator 100 of the present invention less strenuous and more ergonomic for the user.

It was also found that, although blending of the two different paints with a pad applicator eventually occurs, it does not occur as quickly as when using the long-napped wool roller covers 120, 124. For example, when a single pad applicator is used, a first paint must be applied first over a portion of the surface to be decorated, then a second paint is applied over and around the first paint application. This process is repeated to obtain sufficient blending of the two paints and still achieve the textured effect. One problem that arises from this procedure is the paints' tendency to dry too quickly so that blending does not occur in a consistent manner across an entire surface. In order to remedy this problem, anti-drying agents, such as glazes, must be added to the paints to give the user sufficient time to achieve a consistent look across a surface. No such anti-drying agents, or other additives, are necessary under the present invention because drying time of the paints is not nearly as significant a factor. The application time with the pair of long-napped wool roller covers 120, 124 is so quick that normal paints may be used without causing a problem. For example, the invention has been tested, in one instance, by painting a 12 foot by 14 foot wall using a two color first application, and then applying a third color accent paint lightly over the whole surface. A decorative surface finish having the desired effect was produced in only 45 minutes. Use of the present invention to decorate a surface is also faster than conventional single color painting applications because the textured and variegated look of the decorative finish obscures more imperfections than standard surface painting can.

One drawback to paint rollers is their inability to apply paint effectively in inside corners. Numerous attempts have been made to rectify this problem by adding to or modifying the rollers. The present invention does not require any additions or modifications to handle inside corner painting due to the inherent nature of the long-napped wool roller covers 120, 124. By aligning the roller covers 120, 124 with the axis along the line of the corner, the roller covers 120, 124 may be pressed into the corner so that the wool layers 122 contact the intersecting surfaces forming the corner and the line of intersection. The thickness of the long-napped wool layers 122 cushions the roller covers 120, 124 allowing the wool layers 122 to conform to the corner shape without the core 121 contacting the surfaces and marring the paint already applied. The paint applicator 100 may be flipped so that subsequent layers of a different paint are applied by the other roller cover, thereby ensuring the blending of the paints. By repeated application into the inside corner along its length using this technique, the inside corner surfaces will obtain a decorative finish consistent with that of the other surface areas.

Once a decorative surface finish has been produced on a surface 162 or 170 by the paint applicator 100, the long-napped wool roller covers 120, 124 must be cleaned so that they may be reused again and again. Cleaning of the natural wool roller covers 120, 124 is as easy as rinsing them under clean running water until the paint is removed. A simple shaking after rinsing will restore the nap to being smooth and fluffy, requiring nothing more than air drying. The use of different types of coatings may require the use of other types of fluid cleansers, however it is important that the natural characteristics of the wool are not changed, such as by the removal of the natural oils. The use of detergents is not recommended.

The present invention has been illustrated using a pair of long-napped wool roller covers producing a specifically described decorative finish. It should be understood that the choice of paints or coatings, especially the difference in the visually perceptible characteristic chosen, combined with the application technique used by the user will affect the resulting decorative finish provided by any long-napped wool roller cover of the present invention.

Each application will be unique, yet may be substantially similar to another application if the long-napped wool roller cover and paints are the same. The user has the ability to manipulate the paint applicator to produce a decorative finish having very defined paint deposits, a decorative finish that is extremely blended with only subtle paint deposits, or any variation in between. This ability of the user to manipulate the applicator to produce a decorative finish to his or her liking makes the present invention extremely versatile and user friendly. No particular training is required, and the ease of use makes the invention readily available for use by consumers, instead of being limited only to professionals or trained individuals, as many prior decorative finish techniques have been. The apparatus of the present invention is easy to manufacture, and relatively inexpensive to produce, thereby making it a relatively inexpensive decorating option for consumers, that will produce professional quality and decorative results.

Although the present invention has been described with reference to preferred embodiments, workers skilled in the art will recognize that changes may be made in form and detail without departing from the spirit and scope of the invention. The invention is not to be taken as limited to all of the details thereof as modifications and variations thereof may be made without departing from the spirit or scope of the invention.

What is claimed is:

1. A method of quickly applying a soft and subtle decorative finish to a location that includes a relatively smooth and planar surface and an inner corner formed by an intersection of two surfaces, the decorative finish having a substantially similar look as textured decorative finishes formed by much more time consuming methods, the method comprising the steps of:

a. providing first and second paint roller application regions formed from long-napped natural sheepskin wool, with the first and second paint roller application regions mounted on a roller handle;

b. absorbing at least one first and at least one second paint into the natural sheepskin of the first and second paint roller application regions, respectively, the first paint having at least one visually perceptible characteristic that is different from the second paint;

c. causing absorbent and only temporary agglomerations of fibers of the natural wool at an outer surface of each of the first and second paint application regions by rolling the first and second paint application regions over the surface in an overlapping motion resulting in deposits of the first and second paints being laid onto the surface in randomly varying amounts, shapes and orientations, and at least partial blending of some of the first and second paint deposits that are overlaid and intermixed with each other with at least some non-blended first and second paint deposits overlaid upon blended paint deposits, resulting in an uneven painted decorative finish on the surface; and d. continuing the uneven painted decorative finish into the corner by:

i) aligning the first and second paint roller application regions axially with the intersection between the two surfaces;

ii) applying deposits of the first and second paints simultaneously to the corner by pressing the first and second paint roller application regions into the intersection such that the long-napped wool of the first and second paint roller application regions contacts the two surfaces and the intersection simultaneously; and iii) repeating the application of the first and second paints in the corner in an overlapping manner, by rotating the roller handle 180 degrees to facilitate overlapping of the first and second paints, resulting in deposits of the first and second paints being applied onto the two surfaces and the intersection in randomly varying amounts, shapes and orientations with at least partial blending of some of the first and second paint deposits that are overlaid and intermixed with each other, and with at least some non-blended first and second paint deposits overlaid upon blended paint deposits.

2. The method of claim 1, wherein the results from the effect of the paint discharged to the surface by the tips of the long-napped first and second paint roller application regions comprise first and second paint roller covers.

3. The method of claim 2, wherein the first and second paint roller covers are mounted for independent rotation on a dual roller handle.

4. The method of claim 1, wherein the resulting decorative finish is substantially similar to a surface finish created by a wool pad applicator.

5. The method of claim 1, wherein the long-napped wool has a nap length of greater than about ¾ inch.

6. The method of claim 1, wherein the first and second paints are water based, the method further comprising the step of wetting the long-napped wool of the first and second paint roller application regions with water prior to applying the first and second paints, respectively, in order to facilitate absorption and adherence of the first and second paints to the natural wool fibers.

7. The method of claim 1, further comprising the step of cleaning the first and second paint roller application regions upon completion of the decorative finish.

8. The method of claim 7, wherein the step of cleaning comprises:

a. washing and rinsing the long-napped wool of the first and second pain roller application regions in a fluid medium without removing natural wool characteristics; and b. shaking the long-napped wool of the paint roller application regions to remove the fluid medium and restore a fluff to the nap.

9. The method of claim 1, wherein the rolling of the first and second paint roller application regions over the surface occurs in an overlapping and arcing motion.

10. The method of claim 1, wherein the temporary agglomerations act as a plurality of paint brush tips to place paint upon the surface, and then repeatedly reform into substantially new temporary agglomerations acting as a plurality of different paint brush tips upon each roll of the first and second paint roller application regions over the surface.

11. The method of claim 1, wherein the soft and subtle uneven painted decorative finish that results from the method includes a texturizing look without providing actual texture to the surface.

12. The method of claim 1, wherein the step of causing temporary agglomerations includes varying the pressure with which the first and second paint roller application regions contact the surface so as to alter the amount of deposited first and second paints and degree of paint blending occurring during creation of the decorative finish.

* * * * *

UNITED STATES PATENT AND TRADEMARK OFFICE

CERTIFICATE OF CORRECTION

PATENT NO. : 6,284,318 B1
DATED : September 4, 2001
INVENTOR(S) : Susan A. Jackson It is certified that error appears in the above-identified patent and that said Letters Patent is hereby corrected as shown below:

Column 8,
Line 67, add a comma between the words "other" and "with".

Column 9,
Lines 28 and 29, remove the extra language "results from the effect of the paint discharged to the surface by the tips of the long-napped".

Column 10,
Line 12, replace the word "pain" with -- paint --.

Signed and Sealed this

Seventh Day of May, 2002

*Attest:*

*Attesting Officer*

JAMES E. ROGAN
*Director of the United States Patent and Trademark Office*